United States Patent [19]

Hufeld

[11] Patent Number: 5,013,277

[45] Date of Patent: May 7, 1991

[54] AERIAL TOY

[76] Inventor: Gerald R. Hufeld, 9570 Sinnard, Live Oak, Calif. 95953

[21] Appl. No.: 507,093

[22] Filed: Apr. 9, 1990

Related U.S. Application Data

[63] Continuation of Ser. No. 363,177, Jun. 8, 1989, abandoned.

[51] Int. Cl.[5] ..... A63H 27/00

[52] U.S. Cl. ..... 446/34; 446/61

[58] Field of Search ..... 446/34, 36, 61, 63, 446/64, 66, 68, 45; 273/428

[56] References Cited

U.S. PATENT DOCUMENTS

| | | | |
|---|---|---|---|
| 1,651,273 | 11/1927 | Heller | 273/428 X |
| 1,952,952 | 3/1934 | Steiff | 446/64 |
| 2,257,971 | 10/1941 | Lorer . | |
| 2,899,773 | 8/1959 | Lockwood | 446/34 |
| 2,921,404 | 1/1960 | Lescher | 446/34 |
| 3,119,196 | 1/1964 | Alberico et al. | 446/34 |
| 3,353,295 | 11/1967 | Downey | 273/428 X |
| 3,665,641 | 5/1972 | Henderson . | |
| 3,733,737 | 5/1973 | Goodman | 446/68 |
| 3,754,349 | 8/1973 | Wallace | 446/63 |
| 3,947,993 | 4/1976 | Hoppe . | |
| 4,375,138 | 3/1983 | Chotia | 446/64 |
| 4,698,041 | 10/1987 | Dasa | 446/61 |

FOREIGN PATENT DOCUMENTS

| | | | |
|---|---|---|---|
| 641589 | 8/1950 | United Kingdom | 446/34 |

*Primary Examiner*—Mickey Yu
*Attorney, Agent, or Firm*—Jack M. Wiseman

[57] ABSTRACT

An aerial toy having an airfoil made of sheet material mounted on a spine. At one end of the spine is a counterweight and at the other end of the spine is a manually gripping member. The center of mass for the aerial toy when performing as an aerial spinning toy is in the vicinity of the nose end of the aerial toy which includes the counterweight. A launching notch is formed in the counterweight for receiving a catapulting band. The airfoil projects outwardly from the spine and the dimensions of the airfoil decrease from the trailing section of the aerial toy toward the nose section of the aerial toy with the minimum dimension of the airfoil projecting from the spine being in the vicinity of junction between the counterweight, the body, and the airfoil. The aerial toy is converted into a toy glider by detachably securing a delta wing of sheet material to the spine. The delta wing and the airfoil are at right angles to one another.

8 Claims, 3 Drawing Sheets

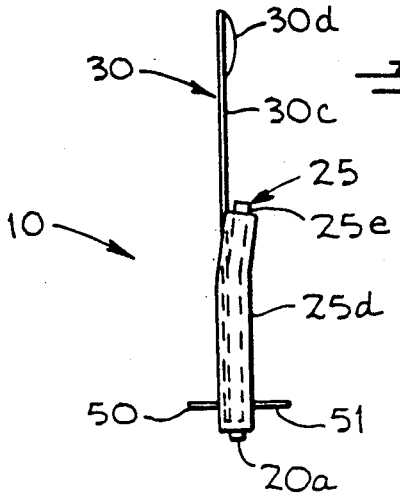
Fig. 4
Fig. 5
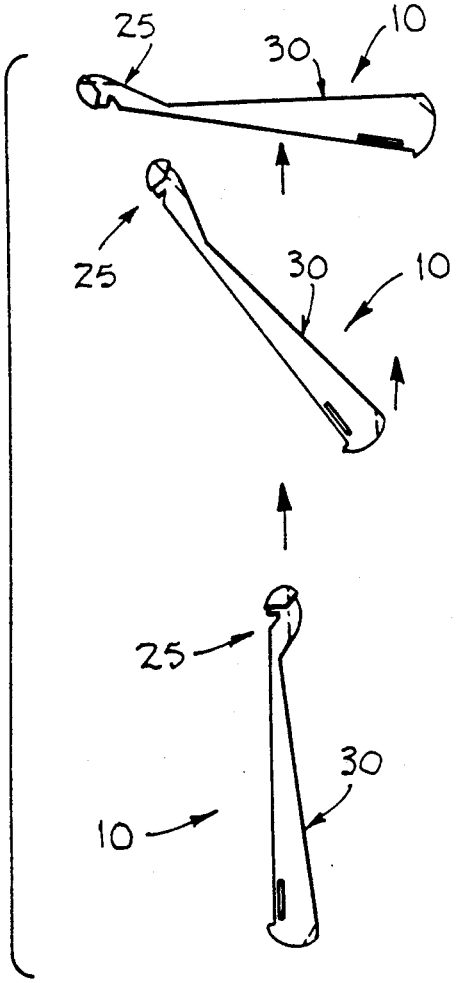
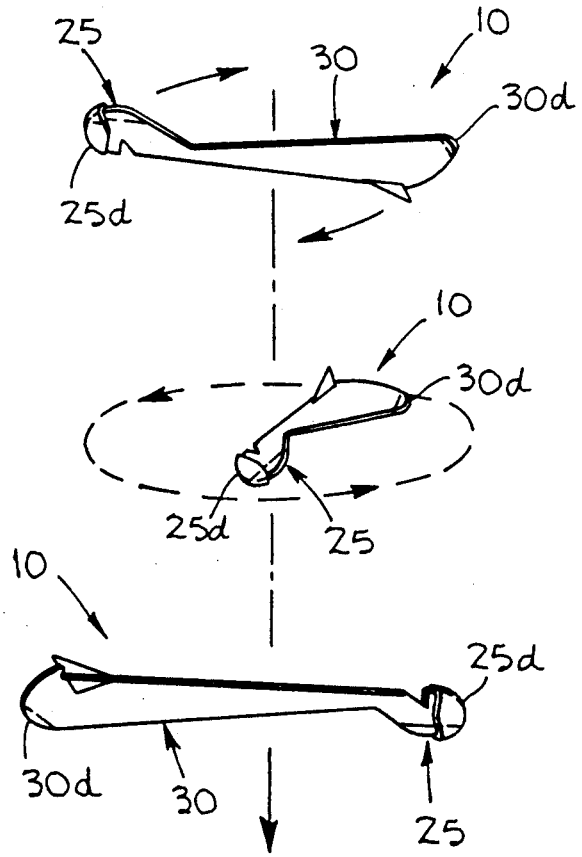
Fig. 6

AERIAL TOY

This is a continuation of copending application(s) Ser. No. 07/363,177 filed on Jun. 8, 1989, abandoned.

BACKGROUND OF THE INVENTION

The present invention relates in general to toys and more particularly to an aerial toy.

The Downey U.S. Pat. No. 3,353,295, issued on Nov. 21, 1967, for Transversely Curved Aerial Toy With Weighted Nose, discloses an aerial toy which may be propelled mechanically into the air by a rubber band. The toy assumes a horizontal attitude as it reaches a high altitude, begins to spin and descends to the ground at a slow rate as it continues to spin.

In the Henderson U.S. Pat. No. 3,665,641, granted on May 30, 1972, for Spin Down, there is disclosed a toy having an airfoil launched from a sling shot. The airfoil has a contour which will cause the toy to spin on its descent after having been projected into the air.

In the Hoppe U.S. Pat. No. 3,947,993, issued on Apr. 6, 1976, for Airfoil And Means For Launching Same, there is disclosed an airfoil having an elongated member. The elongated member terminates at a nose section. In the midsection of the elongated member is a notch for launching the airfoil. At the trailing section of the elongated rotation of the elongated member.

The Lorer U.S. Pat. No. 2,257,971, issued on Oct. 7, 1941, for Aerial Spinning Toy, discloses a spinning toy that is catapulted in the air. The toy includes a base with a weighted tip and a notch for receiving an elastic for the catapulting of the toy.

SUMMARY OF THE INVENTION

An aerial toy comprising an elongated body. At the trailing end of the body is an upturned member for manual gripping by an operator. At the nose end of the body is a counterweight. A launching notch suitable for receiving a catapulting elastic band is formed at the nose end of the body. The center of mass for the aerial toy is in the vicinity of the nose end of the aerial toy when used as an aerial spinning toy. An airfoil includes a base that extends along the body from the trailing section of the body to the nose section of the body. The airfoil projects outwardly from its base and the dimension thereof decreases from the trailing section of the body toward the nose section of the body with the minimum dimension of the airfoil projecting outwardly from the base being in the vicinity of the confronting end of the counterweight.

An object of the present invention is to provide an aerial spinning toy in which an airfoil thereof generates progressive lift to the airfoil tip for providing improved thrust, lift, balance and stability.

Another object of the present invention is to provide an aerial spinning toy that has a relatively slow descent.

A feature of the present invention is the provision of a flap for an airfoil to maneuver the aerial spinning toy to an immediate and correct horizontal attitude, resulting in an immediate rotation.

Another feature of the present invention is the provision of a flap for an airfoil that creates a consistent lift as well as uniform stability.

Another feature of the present invention is the employment of a delta wing in addition to an airfoil for converting an aerial spinning toy to a toy glider.

Another feature of the present invention is the employment of stabilizing wings for an aerial toy that is attached to the base of an airfoil for achieving greater launch heights.

BRIEF DESCRIPTION OF THE DRAWINGS

FIG. 4 is a front elevation view of the aerial spinning toy shown in FIGS. 1–3.

FIG. 5 is a diagrammatic illustration of the launching flight of the aerial spinning toy shown in FIGS. 1–4.

FIG. 6 is a diagrammatic illustration of the descent of the aerial spinning toy shown in FIGS. 1–4.

DESCRIPTION OF THE PREFERRED EMBODIMENT

Figure 1:
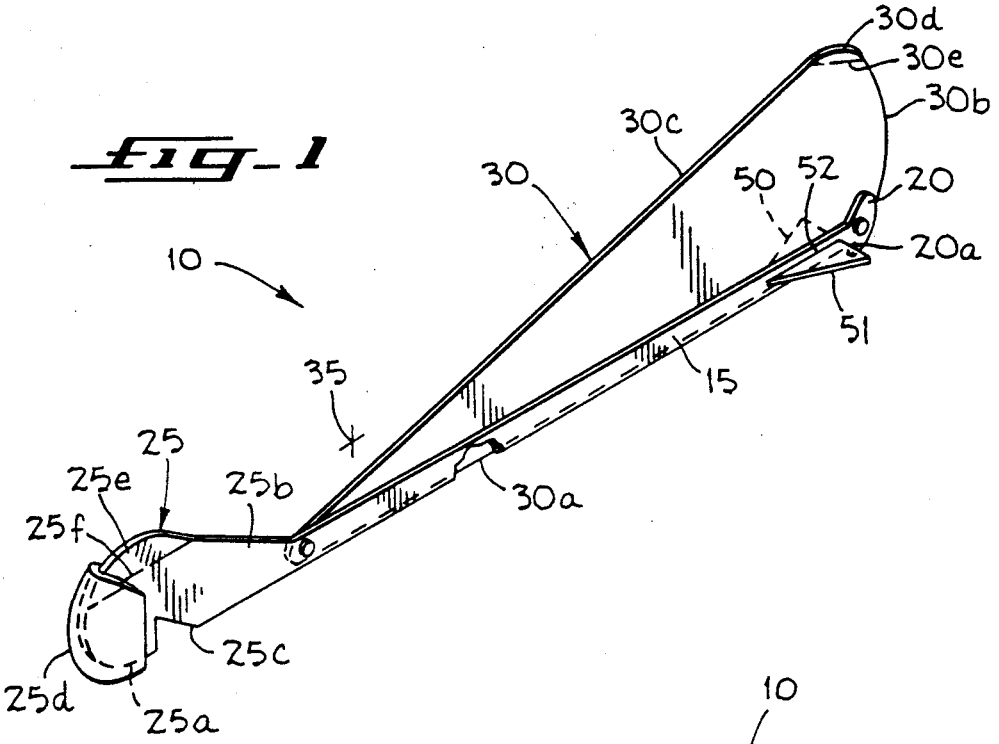
FIG. 1 is a perspective view of an aerial spinning toy embodying the present invention.
Figure 2:
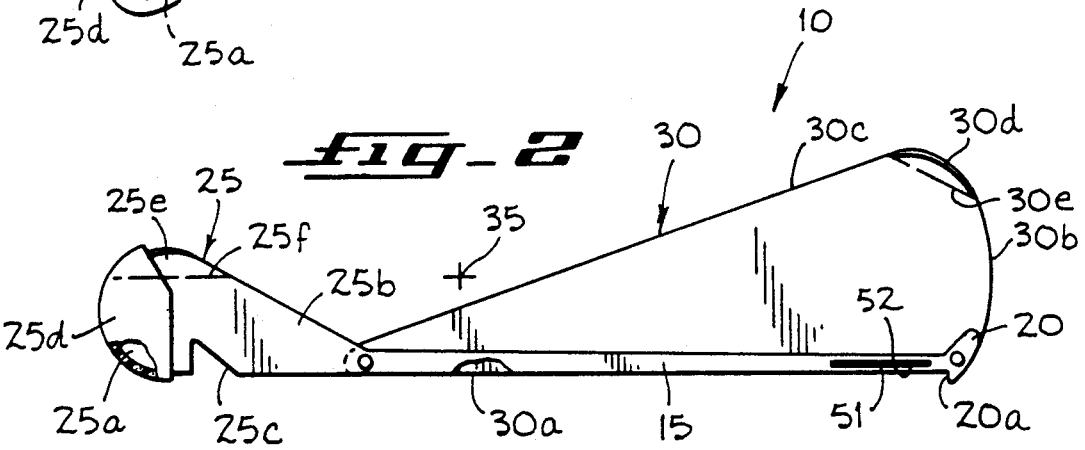
FIG. 2 is a side elevation view of the aerial spinning toy shown in FIG. 1.
Figure 3:
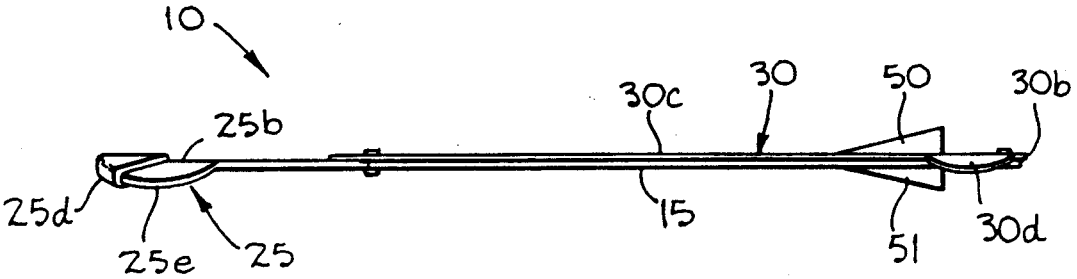
FIG. 3 is a top view of the aerial spinning toy shown in FIGS. 1 and 2.

Illustrated in FIGS. 1–4 is an aerial toy 10 embodying the present invention. The aerial toy 10 comprises a narrow, elongated spine or body 15 (FIGS. 2 and 3) made of suitable lightweight material, such as plastic. It is apparent that the body 15 may be made from other suitable material, such as aluminum, wood or the like. At the trailing end of the aerial toy 10 and projecting from the body 15 in an outwardly direction is an arcuate gripping member 20 suitable for manual gripping by an operator (FIGS. 1 and 2). In the exemplary embodiment, the gripping member 20 may be made of the same material as the body 15 and may be integrally formed therewith. At the lower extremity of the gripping member 20 is an abutment **20*a***.

At the nose end of the aerial toy 10 is a counterweight 25 (FIGS. 1 and 2), which has a semi-cylindrical section **25*a* and a continuing angular section 25*b*. In the exemplary embodiment, the sections 25*a* and 25*b* of the counterweight 25 may be made of the same material as the body 15 and may be integrally formed therewith. The width of the body 15, the section 25*a* and the section 25**, in the exemplary embodiment, are the same and the sides thereof define opposing parallel planar surfaces within close proximity to one another.

Formed in the counterweight 25 along the lower extremity thereof and between the sections **25*a* and 25*b* thereof is a suitable launching notch 25*c* (FIG. 2) to accommodate a propelling device, such as an elastic band. The elastic band is tensioned by pulling actions from an operator and the release of the tensioning force from the trailing end of the aerial toy 10 by the operator causes a propelling force to be exerted on the aerial toy 10 for launching or for catapulting the aerial toy 10 with the nose end of the aerial toy 10 leading the trailing end of the aerial toy 10 (FIG. 5**).

Fixed to the counterweight 25 is a nose guard **25*d* (FIGS. 1 and 2) that serves to protect the operator or bystander from injury in the event the aerial toy 10** crashes into the operator or bystander. The nose guard 25*d*, in the preferred embodiment, has a U-shaped configuration and embraces the free end of the counterweight 25. The legs of the nose guard 25*d* are directed in the direction of the body 15 of the aerial toy 10 and the interconnecting member of the nose guard 25*d* is located forwardly of the nose end of the aerial toy 10. In the exemplary embodiment, the nose guard 25*c* is made of suitable soft, yieldable material, such as polyfoam material.

Extending along the body 15 in fixed relation thereto is an airfoil 30 (FIG. 2). The base 30*a* (FIGS. 1 and 4) of the airfoil 30 is fixedly secured to the elongated body 15 in parallel relation therewith. An arcuate outwardly directed leg 30*b* (FIGS. 1 and 2) of the airfoil 30 projects from the base 30*a* in the vicinity of the gripping member 20 of the body 15, which is the trailing end of the aerial toy 10. A leg 30*c* of the airfoil 30 extends from the free end of the arcuate leg 30*b* to the base 30*a* in the vicinity of the counterweight 25 (FIG. 2). The airfoil 30, in the preferred embodiment, is made from a thin sheet of plastic, such as a polycarbonate, and defines opposing planar surfaces in close proximity to one another. In the exemplary embodiment, the airfoil 30 is 7/1000 of an inch thick. The plastic material from which the airfoil 30 is made is more flexible and lighter than the plastic material from which the body 15 is made. While a plastic sheet is preferred for the construction of the airfoil 30, it is apparent that the airfoil 30 may be made from aluminum or wood. In the preferred embodiment, the airfoil 30 and the body 15 may be made from similar material and may be molded as a unitary structure.

As viewed in FIG. 2, the airfoil 30 has a generally triangular configuration. The center of mass or centroid for the aerial toy 10 performing as an aerial spinning toy is located approximately at a point 35 in FIGS. 1 and 2. The airfoil 30 has its maximum dimension outwardly from the base 30*a* along the leg 30*b*, which is at the trailing end of the aerial toy 10. The airfoil 30 declines along the leg 30*c* from the free end of the leg 30*b* and joins the base 30*a* at the junction between the section 25*b* of the counterweight 25 and the base 15. The center of mass or centroid 35 for the toy 10 performing as an aerial spinning toy is located in the general vicinity of the nose end of the aerial toy 10.

Formed on the counterweight 25 opposite of the launching notch 25*c* and including portions of the counterweight sections 25*a* and 25*b* is a foldable flap 25*e* which is foldable over a fold line 25*f* (FIGS. 1 and 2). The flap 25*e* controls the wing angle of attack on the airfoil 30. Air under pressure applied against the angular surfaces of the flap 25*e* turns the leading edge of the airfoil 30 at an upward angle of attack producing a high lift component under the airfoil 30. During descent of the aerial toy 10 as an aerial spinning toy, the flap 25*e* tends to slow the speed of spinning descent of the aerial toy 10.

By virtue of the configuration of airfoil 30, the location of the leg 30*b*, and the location of the centroid 35, the airfoil 30 generates a progressive lift along its planar surfaces producing an improved thrust, lift and balance when the aerial toy 10 is performing as an aerial spinning toy. Additionally, a slight dihedral or coning effect is created for improved stability.

In the vicinity of the junction between the leg 30*b* and the leg 30*c* is a flap 30*d*. The flap 30*d* is folded about a fold line 30*e* (FIG. 2). When the launch momentum of the aerial toy 10 as an aerial spinning toy is reduced to the point that the aerial spinning toy 10 has reached its apex for the launch, the flap 30*d* functions as a rudder for turning the aerial spinning toy 10 to an immediate and correct horizontal attitude (FIGS. 5 and 6). This action results in an immediate descending, spinning flight for the aerial spinning toy 10 (FIG. 6). Additionally, the flap 30*d* controls the speed of rotation of the aerial spinning toy 10. The larger the extent of the flap 30*d*, the greater the lift component and the slower the speed or rotation and the slower the descent, thus maintaining a slow descent flight integrity. This action is brought about by the flap 30*d* compressing the air applied to the airfoil 30. The maximum extent for the flap 30*d* is generally 25°.

During the spinning descent of the aerial toy 10, the flap member 30*d* functions to extend the chord or span of the airfoil 30. In so doing, the flap member 30*d* compresses the air below the airfoil 30 to produce a more consistent lift and uniform stability. The flap 30*d* controls the speed of rotation of the aerial toy 10 during the spinning descent thereof without interferring with flight integrity when the airfoil 30 is subjected to excessive high angles of attack.

In the vicinity of the trailing end of the aerial toy 10 are removably disposed stabilizing wings 50 and 51 (FIGS. 1–4). The stabilizing wings 50 and 51 are mounted within a slot 52 formed in the body 15 (FIGS. 1 and 2). In the exemplary embodiment, the stabilizing wings 50 and 51 are made from a unitary panel divided into two equal sections by the body. In the preferred embodiment, the stabilizing wings 50 and 51 are made from the same material as the airfoil 30.

By virtue of the stabilizer wings 50 and 51, the aerial toy 10 when performing as an aerial spinning toy has the airfoil 30 and the body 15 thereof stabilized to achieve greater launch heights. Should shorter launch heights be desired, the stabilizer wings 50 and 51 may be removed.

In the operation of the aerial toy 10 as an aerial spinning toy, an operator initially grips manually the gripping member 10 at the trailing end of the aerial toy 10 with one hand and with the other hand places an elastic band in the launching notch 25*c*. The hand gripping the gripping member 20 tensions the elastic band, while the elastic band is disposed in the launching notch 25*c*. The elastic band, while in the launching notch 25*c*, is brought forward of the nose end of the aerial toy 10 in an upwardly and outwardly direction by the operator. The nose end of the aerial toy 10 is directed upwardly while the trailing end of the aerial toy 10 is disposed below the nose end of the aerial toy 10 and the aerial toy 10 is disposed generally vertical.

The operator pulls downwardly on the trailing section of the aerial toy 10 by gripping the gripping member 20 and simultaneously pulls upwardly and outwardly on the elastic band disposed in the launching notch 25*c*. This action tensions the elastic band for propelling the aerial toy 10. Thereupon, the operator releases the gripping member 20 and the elastic band catapults the aerial toy 10 into space. The aerial toy 10 is launched vertically into space with the nose end of the aerial toy 10 vertically above the trailing end of the aerial toy 10.

The aerial toy 10, when launched as an aerial spinning toy, will climb in a direct vertical flight path similar to an arrow until it reaches the apex of its flight (FIG. 5). As the aerial toy 10 performing as a aerial spinning toy reaches the apex of its flight, it enters into a horizontal attitude at the apex of its flight. As the aerial toy 10 performing as an aerial spinning toy assumes a horizontal attitude at the apex of its flight, it begins to spin and begins to descend to ground. The aerial toy 10 performing as an aerial spinning toy descends to ground while continuously spinning or rotating (FIG. 6). The aerial toy 10 as an aerial spinning toy begins to descend when the momentum imparted to it from the propelling force of the elastic band has been spent or exhausted.

During the generally horizontal rotating descent of the aerial spinning toy 10, the airfoil 30 is tilted upwardly approximately 10° from the air under pressure applied to the lower surface thereof (FIG. 6) and the counterweight 25 is pushed downwardly from the air under pressure applied to the upper surface thereof. The attack angle on the airfoil 30 is from 6° to 10°. This action continues until the slow descent to ground is completed by the aerial spinning toy 10.

The aerial toy 10 may be converted into a toy glider (FIGS. 7-10). Toward this end, the body 15 is received by a narrow elongated channel member 40*a* (FIGS. 7 and 10) of a delta wing 40. In the exemplary embodiment, the channel 40*a* is detachably secured to the body 15 and may be made of the same material as the body 15. It is within the contemplation of the present invention that the member 40*a* may be integrally formed with the body 15 should the aerial toy 10 be used solely as a toy glider.

When the channel member 40*a* is detachably secured to the body 15, the channel member 40*a* is slid onto the body 15 and is supported thereby in a well-known close or tight fit relationship.

Figure 7:
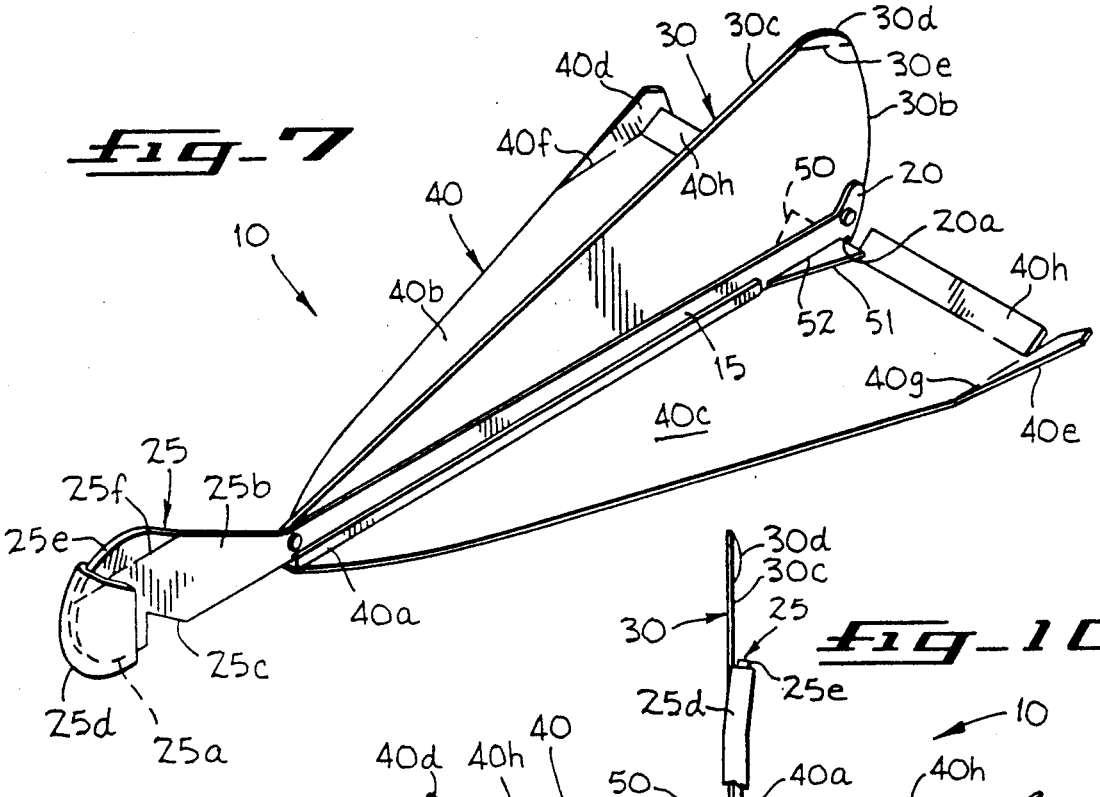
FIG. 7 is a perspective view of a modification of the aerial spinning toy shown in FIGS. 1–4 converting the same to a toy glider.
Figure 10:
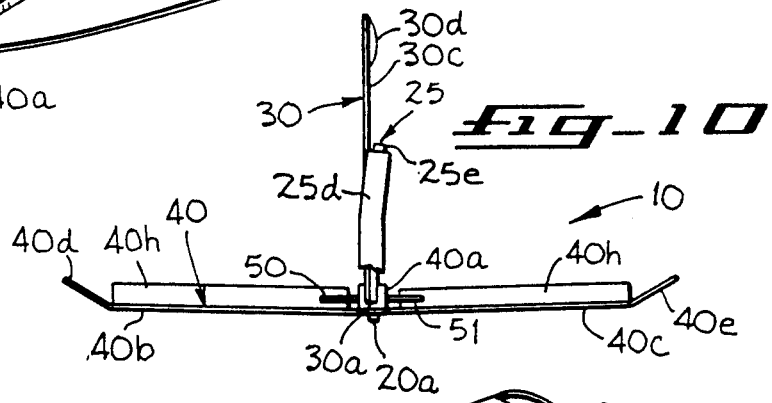
FIG. 10 is a front elevation view of the toy glider shown in FIGS. 7–9.
Figure 8:
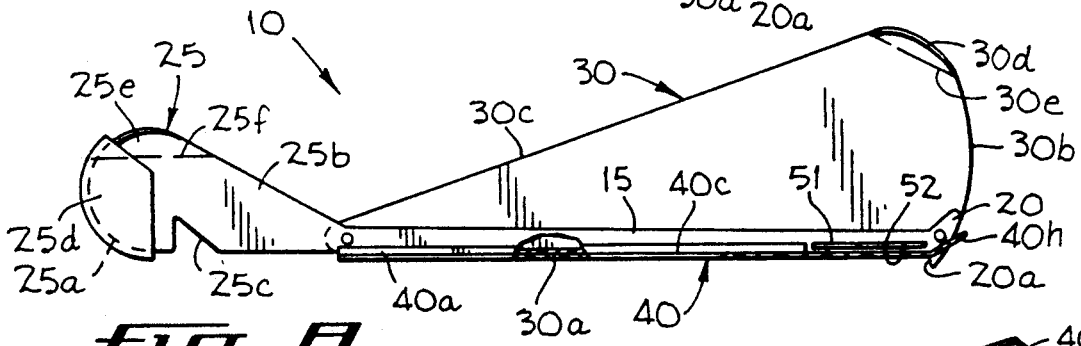
FIG. 8 is a fragmentary side elevation view of the toy glider shown in FIG. 7.
Figure 9:
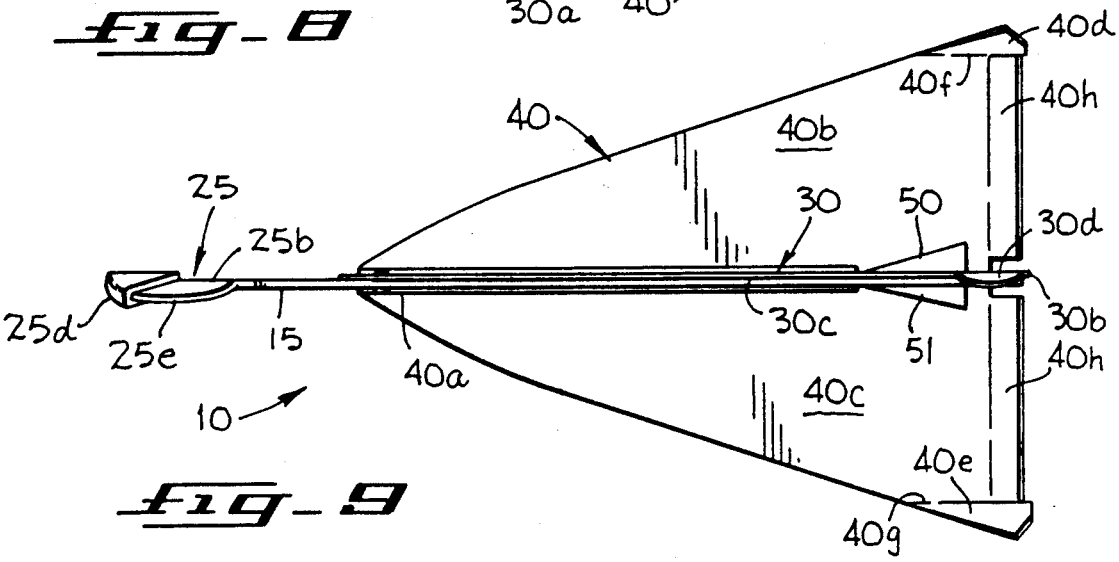
FIG. 9 is a top view of the toy glider shown in FIGS. 7 and 8.

The delta wing 40 comprises a unitary panel which is fixedly secured to the channel member 40*a* on the surface thereof opposite from the channel that receives the body 15. The unitary panel is divided into two equal triangular sections 40*b* and 40*c* by the channel member 40*a* (FIG. 9). The airfoil 30 is at right angles to the delta wing 40 (FIGS. 7-10). The apex of the delta wing 40 is located in the general vicinity of the junction between the counterweight 25, the body 15, and the airfoil 30. The delta wing 40 gradually increases in width and has its maximum width in the vicinity of the trailing end of the airfoil 30 (FIGS. 7 and 10).

The delta wing 40 is formed with winglets 40*d* and 40*e* which are secured about fold lines 40*f* and 40*g*, respectively. The winglets 40*d* and 40*e* are located at the maximum width of the delta wing 40, which is located at the trailing end of the aerial toy 10. The delta wing 40 is an optional component of the aerial toy 10 and when employed enables the aerial toy 10 to function as a toy glider. At the maximum width of the delta wing 40 and extending between the winglets 40*d* and 40*e* of the wing 40 is an elevator 40*h*. The delta wing 40, its winglets 40*d* and 40*e* and its elevator 40*h*, enable the aerial toy 10 to increase the flight distance during the launching of the aerial toy 10 as a toy glider.

In the operation of the aerial toy 10 as a toy glider, an operator initially grips manually the gripping member 10 at the trailing end of the aerial toy 10 with one hand and with the other hand places an elastic band in the launching notch 25*c*. The hand gripping the gripping member 20 tensions the elastic band, while the elastic band is disposed in the launching notch 25*c*. The elastic band, while in the launching notch 25*c*, is brought forward of the nose end of the aerial toy 10 in an upwardly and outwardly direction by the operator. The nose end of the aerial toy 10 is directed upwardly while the trailing end of the aerial toy 10 is disposed below the nose end of the aerial toy 10 and the aerial toy 10 is disposed at an inclining angle.

The operator pulls downwardly on the trailing section of the aerial toy 10 by gripping the gripping member 20 and simultaneously pulls upwardly and outwardly on the elastic band disposed in the launching notch 25*c*. This action tensions the elastic band for propelling the aerial toy 10. Thereupon, the operator releases the gripping member 20 and the elastic band catapults the aerial toy 10 into space. The aerial toy 10 is launched upwardly into space with the nose end of the aerial toy 10 above the trailing end of the aerial toy 10.

The aerial toy 10, when launched as a toy glider, will climb in an inclined flight path until it reaches the apex of its flight. As the aerial toy 10 performing as a toy glider reaches the apex of its flight, it enters into a generally horizontal attitude at the apex of its flight. As the aerial toy 10 performing as a toy glider assumes a horizontal attitude at the apex of its flight, it begins to decend to ground as a toy glider. The aerial toy 10 as a toy glider begins to descend when the momentum imparted to it from the propelling force of the elastic band has been spent or exhausted.

What is claimed is:

1. An aerial toy propelled by an elastic band under tension, said aerial toy comprising:

(a) an elongated body having a plurality of extremities;

(b) a nose section disposed at one extremity of said body, said nose section being formed with a launching notch to receive an elastic band to be tensioned for propelling said aerial toy;

(c) a trailing section disposed at another extremity of said body; and (d) an airfoil secured substantially along the entire length thereof to said body and extending from said trailing section to said nose section, said airfoil being formed from a flexible sheet having opposing parallel planar surfaces, said airfoil projecting outwardly from said body and decreasing in the extent of its projection from said body in the direction from said trailing section toward said nose section, said nose section being in the form of a counterweight in which said launching notch is formed, said trailing section including a manual gripping tab projecting from and integrally formed with said body to be grasped by an operator.

2. An aerial toy propelled by an elastic band under tension, said aerial toy comprising:

(a) an elongated body having a plurality of extremities;

(b) a nose section disposed at one extremity of said body, said nose section being formed with a launching notch to receive an elastic band to be tensioned for propelling said aerial toy;

(c) a trailing section disposed at another extremity of said body; and (d) an airfoil secured substantially along the entire length thereof to said body and extending from said trailing section to said nose section, said airfoil being formed from a flexible sheet having opposing parallel planar surfaces, said airfoil projecting outwardly from said body and decreasing in the extent of its projection from said body in the direction from said trailing section toward said nose section, said nose section being in the form of a counterweight in which said launching notch is formed, (e) said counterweight being formed with a flap at a leading section thereof removed from said launching notch for controlling the angle of air under pressure applied against said airfoil to produce a high lift angle of attack under said airfoil.

3. An aerial spinning toy propelled by an elastic band under tension, said aerial spinning toy comprising:

(a) an elongated body having a plurality of extremities;

(b) a nose section disposed at one extremity of said body, said nose section being formed with a launching notch to receive an elastic band to be tensioned for propelling said aerial spinning toy;

(c) a trailing section disposed at another extremity of said body; and (d) an airfoil secured substantially along the entire length thereof to said body and extending from said trailing section to said nose section, said airfoil projecting outwardly from said body and decreasing in the extent of its projection from said body in the direction from said trailing section toward said nose section along the entire length thereof, said decreasing projection of said airfoil defining a declining leg, (e) said aerial spinning toy having a center of mass generally in close proximity to the shortest extent of the projection of said airfoil from said body and spaced from and removed from said body, said nose section, said trailing section and said airfoil.

4. An aerial spinning toy as claimed in claim 3 wherein said nose section includes a counterweight in which said launching notch is formed.

5. An aerial spinning toy as claimed in claim 4 wherein said trailing section includes a manual gripping tab projecting from and integrally formed with said body to be grasped by an operator.

6. An aerial spinning toy as claimed in claim 3 wherein said airfoil is formed from a flexible sheet having opposing parallel planar surfaces.

7. An aerial spinning toy propelled by an elastic band under tension, said aerial spinning toy comprising:

(a) an elongated body having a plurality of extremities;

(b) a nose section disposed at one extremity of said body, said nose section being formed with a launching notch to receive an elastic band to be tensioned for propelling said aerial spinning toy;

(c) a trailing section disposed at another extremity of said body; and (d) an airfoil secured substantially along the entire length thereof to said body and extending from said trailing section to said nose section, said airfoil projecting outwardly from said body and decreasing in the extent of its projection from said body in the direction from said trailing section toward said nose section, said decreasing projection of said airfoil defining a declining leg, (e) said aerial spinning toy having a center of mass generally in close proximity to said nose section, (f) said nose section including a counterweight in which said launching notch is formed, (g) said counterweight being formed with a flap at a leading section thereof removed from said launching notch for controlling the angle of air pressure applied against said airfoil to produce a high lift angle of attack under said airfoil.

8. An aerial toy propelled by an elastic band under tension, said aerial toy comprising:

(a) an elongated body having a plurality of extremities;

(b) a nose section disposed at one extremity of said body, said nose section being formed with a launching notch to receive an elastic band to be tensioned for propelling said aerial toy;

(c) a trailing section disposed at another extemity of said body; and (d) an airfoil secured to said body and extending between said trailing section and said nose section, said airfoil being formed from a flexible sheet having opposing parallel planar surfaces, said airfoil projecting outwardly from said body and decreasing in the extent of its projection from said body in the direction from said trailing section toward said nose section, said nose section being in the form of a counterweight in which said launching notch is formed, (e) said counterweight being formed with a flap at a leading section thereof removed from said launching notch for controlling the angle of air under pressure applied against said airfoil to produce a high lift angle of attack under said airfoil.

* * * * *